US006202659B1

(12) United States Patent
Sachs

(10) Patent No.: US 6,202,659 B1
(45) Date of Patent: Mar. 20, 2001

(54) SUNSHADE DEVICE

(75) Inventor: Robert Sachs, Taichung (TW)

(73) Assignee: Chen-Hsiung Lin, Chia I Hsien (TW)

( * ) Notice: Subject to any disclaimer, the term of this patent is extended or adjusted under 35 U.S.C. 154(b) by 0 days.

(21) Appl. No.: 09/449,445

(22) Filed: Nov. 25, 1999

(51) Int. Cl.[7] ..... A45B 11/00; A45B 17/00

(52) U.S. Cl. ..... 135/20.1; 135/20.3; 135/87; 135/95; 135/142; 135/151; 248/121; 248/122.1; 248/125.8

(58) Field of Search ..... 135/87, 95, 20.3, 135/139, 141, 151, 143, 154, 155, 114, 15.1, 20.1, 142; 248/121, 122.1, 125.8

(56) References Cited

U.S. PATENT DOCUMENTS 1,409,609 * 3/1922 Stockle .
1,653,772 * 12/1927 Knoche .
2,828,758 * 4/1958 Moro ..... 135/20.3
2,863,466 * 12/1958 Small ..... 135/20.3
2,888,021 * 5/1959 Adams .
3,419,295 * 12/1968 Small ..... 135/20.3 X
4,068,673 * 1/1978 Bernardi ..... 135/155 X
4,082,102 * 4/1978 Heuer ..... 135/155 X
4,836,232 * 6/1989 DeRosa et al. ..... 135/99
4,877,045 * 10/1989 Lin ..... 135/20.3
5,579,797 * 12/1996 Rogers ..... 135/90
5,711,331 * 1/1998 Harris ..... 135/16

* cited by examiner

*Primary Examiner*—Robert Canfield
(74) *Attorney, Agent, or Firm*—Alan Kamrath; Rider Bennett Egan & Arundel, LLP.

(57) ABSTRACT

A sunshade device has a sunshade awning, a clamp device, an angle adjusting device, and an extensible support. The sunshade awning has a flexible steel ring and a fabric. The extensible support has an outer pipe, and an inner pipe inserted in the outer pipe. The clamp device has a lower tube, a first clamping plate, and a second clamping plate. The first clamping plate and the second clamping plate clamp the flexible steel ring. The angle adjusting device has an upper sleeve inserted in the lower tube and a lower sleeve engaging with the upper sleeve. The lower sleeve has a lower pipe inserted in the inner pipe.

4 Claims, 10 Drawing Sheets

SUNSHADE DEVICE

BACKGROUND OF THE INVENTION

The present invention relates to a sunshade device. More particularly, the present invention relates to a sunshade device which has an angle adjusting device to adjust an angle of a sunshade awning.

Referring to FIG. 11, a conventional sunshade device has a support rod 20, a stiff annular frame 10 supported by the support rod 20, and a fabric enclosed by the stiff annular frame 10. Since the stiff annular frame 10 occupy a large room, it is difficult to carry the stiff annular frame 10 or to store the stiff annular frame 10. Further, the angle of the stiff annular frame 10 cannot be adjusted.

SUMMARY OF THE INVENTION

An object of the present invention is to provide a sunshade device which has an angle adjusting device to adjust an angle of a sunshade awning.

Another object of the present invention is to provide a sunshade device which has a clamp device to clamp a sunshade awning stably or to be detached easily.

Another object of the present invention is to provide a sunshade awning which has a flexible steel ring to be disengaged from a clamp device and to be folded so that the sunshade awning can be folded.

Accordingly, a sunshade device comprises a sunshade awning, a clamp device, an angle adjusting device, and an extensible support. The sunshade awning has a flexible steel ring and a fabric enclosed by the flexible steel ring. The extensible support has an outer pipe and an inner pipe inserted in the outer pipe. The clamp device has a lower tube, a first clamping plate, a second clamping plate disposed on the lower tube, and the second clamping plate engaging with the first clamping plate. The first groove of the first clamping plate and the second groove of the second clamping plate receive the flexible steel ring. The angle adjusting device has an upper sleeve inserted in the lower tube and a lower sleeve engaging with the upper sleeve. The upper sleeve has an insertion journal, a pivot hole formed in the insertion journal, a click flange disposed on a bottom of the insertion journal, and a plurality of recesses formed on the click flange. The lower sleeve has a lower pipe inserted in the inner pipe, an upper notch receiving the insertion journal, a chamber formed beneath the upper notch, a generally oblong hole communicating with the chamber, and a through hole matching the pivot hole of the insertion journal. The chamber receives a push block. The push block has a positioning post and a confining protrusion. The confining protrusion of the push block is inserted in one of the recesses of the click flange. The generally oblong hole of the lower sleeve receives a coiled spring. The positioning post of the push block is inserted in an end of the coiled spring. A pivot pin fastens the lower sleeve and the upper sleeve pivotally via the through hole of the lower sleeve and the pivot hole of the upper sleeve. When the push block is pushed inward, the confining protrusion of the push block is disengaged from one of the recesses of the click flange and the angle of the upper sleeve will be adjusted. When the push block is released, the confining protrusion of the push block will be inserted in one of the recesses of the click flange.

DETAILED DESCRIPTION OF THE INVENTION

Figure 1:
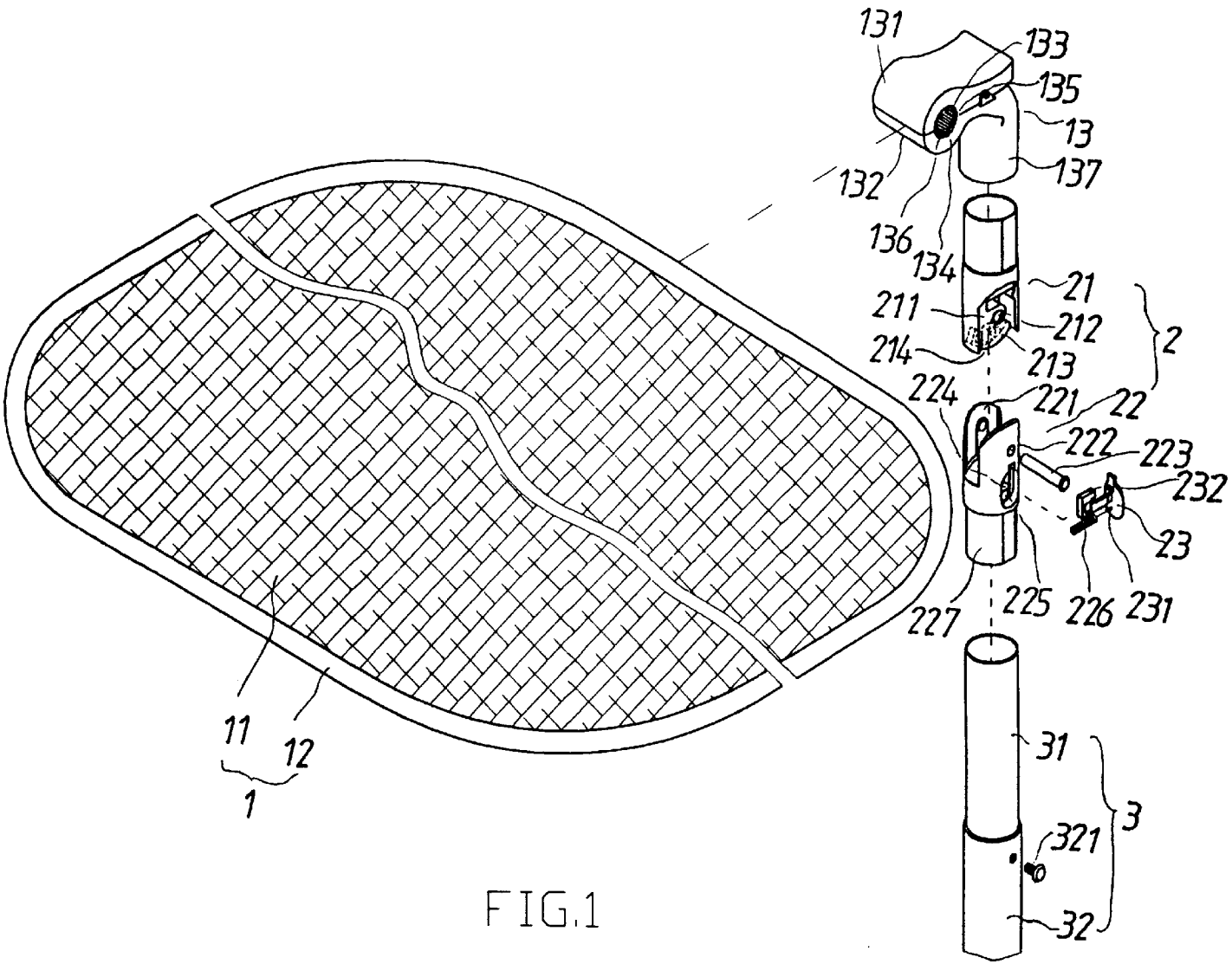
FIG. 1 is a perspective exploded view of a sunshade device of a preferred embodiment in accordance with the present invention.
Figure 2:
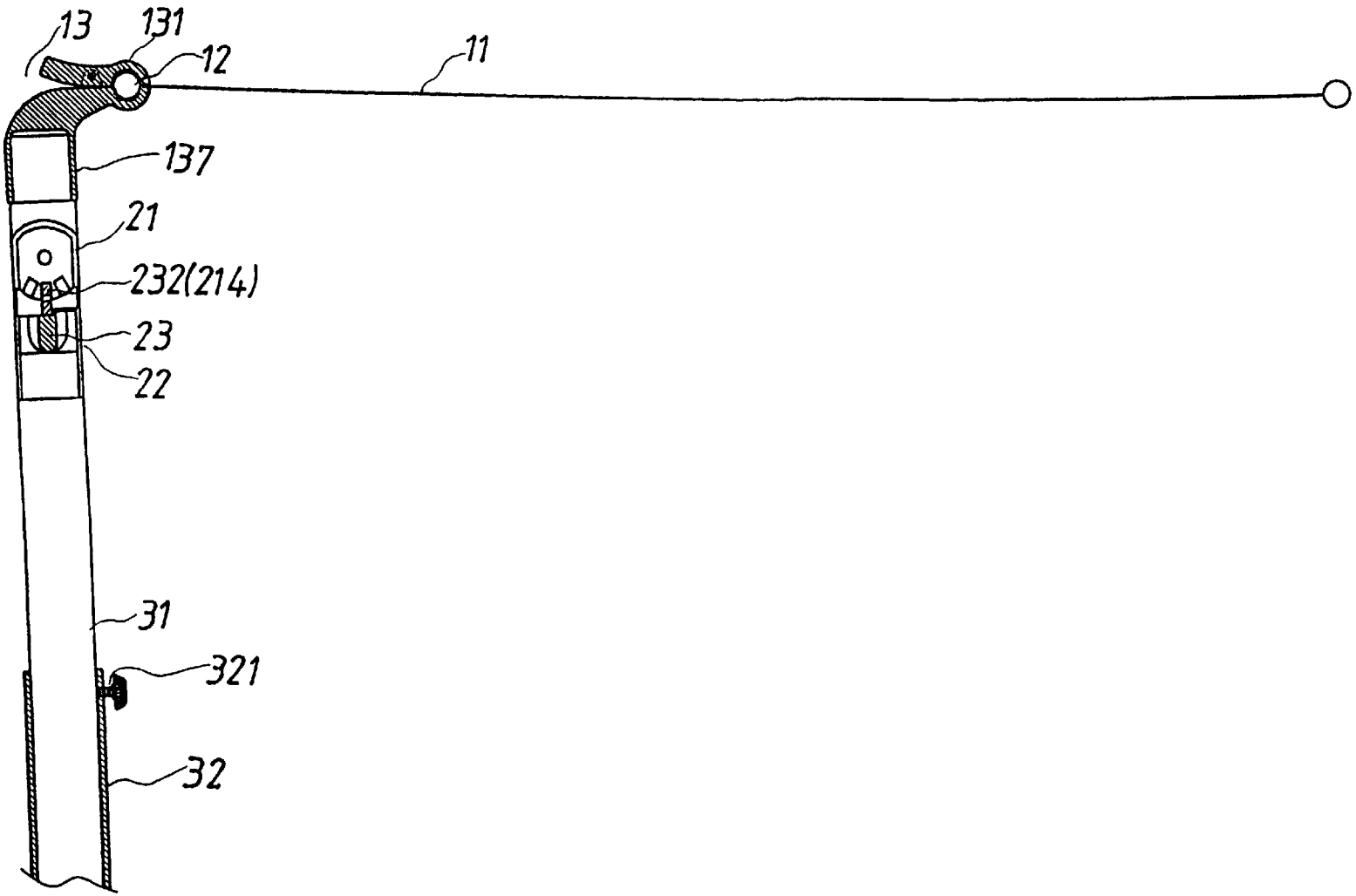
FIG. 2 is a sectional assembly view of a sunshade device of a preferred embodiment in accordance with the present invention.
Figure 3:
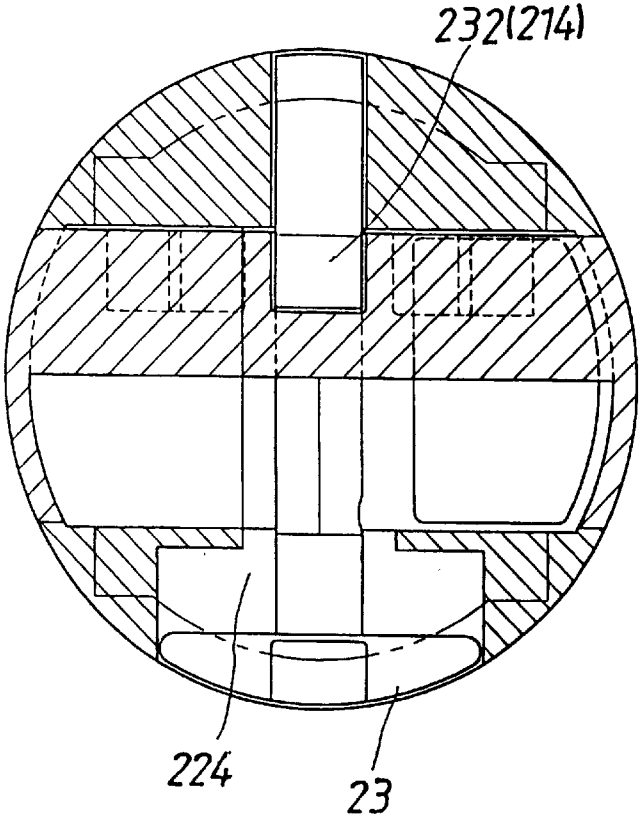
FIG. 3 is a sectional assembly view of an angle adjusting device of a preferred embodiment in accordance with the present invention.

Referring to FIGS. 1 to 3, a sunshade device comprises a sunshade awning 1, a clamp device 13, an angle adjusting device 2, and an extensible support 3.

The sunshade awning 1 has a flexible steel ring 12 and a fabric 11 enclosed by the flexible steel ring 12.

The extensible support 3 has an outer pipe 32, an inner pipe 31 inserted in the outer pipe 32, and an adjustment bolt 321 fastening the outer pipe 32 and the inner pipe 31 together.

The clamp device 13 has a lower tube 137, a first clamping plate 131, a second clamping plate 132 disposed on the lower tube 137, and the second clamping plate 132 engaging with the first clamping plate 131.

The first clamping plate 131 has a first groove 133 and a plurality of first corrugated ribs 135.

The second clamping plate 132 has a second groove 134 and a plurality of second corrugated ribs 136.

The first groove 133 of the first clamping plate 131 and the second groove 134 of the second clamping plate 132 receive the flexible steel ring 12.

The angle adjusting device 2 has an upper sleeve 21 inserted in the lower tube 137 and a lower sleeve 22 engaging with the upper sleeve 21.

The upper sleeve 21 has an insertion journal 211, a pivot hole 212 formed in the insertion journal 211, a click flange 213 disposed on a bottom of the insertion journal 211, and a plurality of recesses 214 formed on the click flange 213.

The lower sleeve 22 has a lower pipe 227 inserted in the inner pipe 31, an upper notch 221 receiving the insertion journal 211, a chamber 224 formed beneath the upper notch 221, a generally oblong hole 225 communicating with the chamber 224, and a through hole 222 matching the pivot hole 212 of the insertion journal 211.

The chamber 224 receives a push block 23. The push block 23 has a positioning post 231 and a confining protrusion 232.

The confining protrusion 232 of the push block 23 is inserted in one of the recesses 214 of the click flange 213.

The generally oblong hole 225 of the lower sleeve 22 receives a coiled spring 226.

The positioning post 231 of the push block 23 is inserted in an end of the coiled spring 226.

A pivot pin 223 fastens the lower sleeve 22 and the upper sleeve 21 pivotally via the through hole 222 of the lower sleeve 22 and the pivot hole 212 of the upper sleeve 21.

Figure 6:
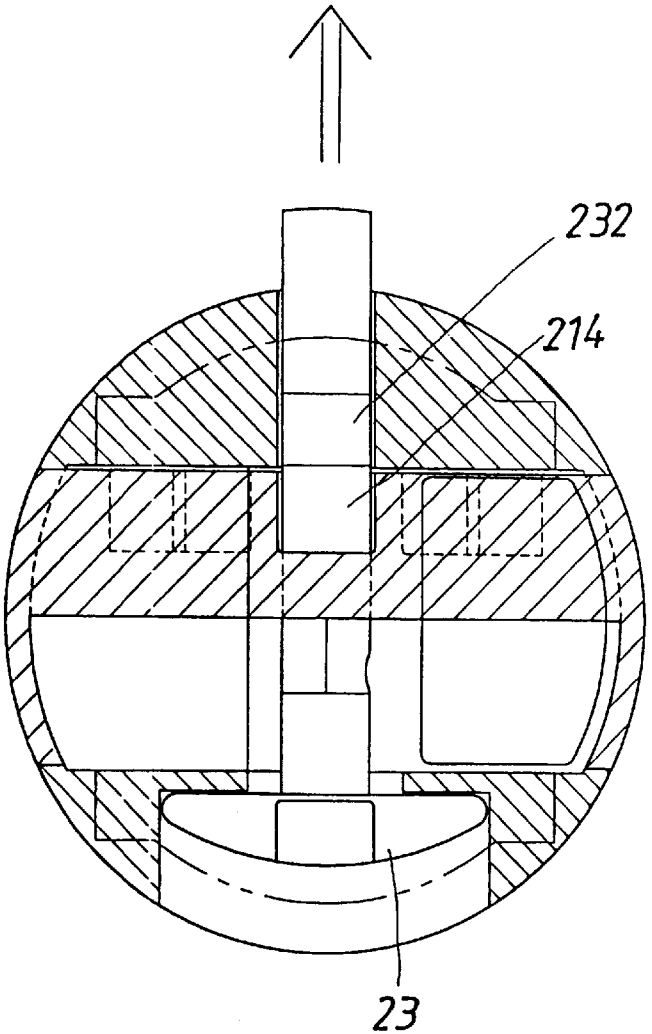
FIG. 6 is another sectional assembly view of an angle adjusting device of a preferred embodiment in accordance with the present invention.
Figure 7:
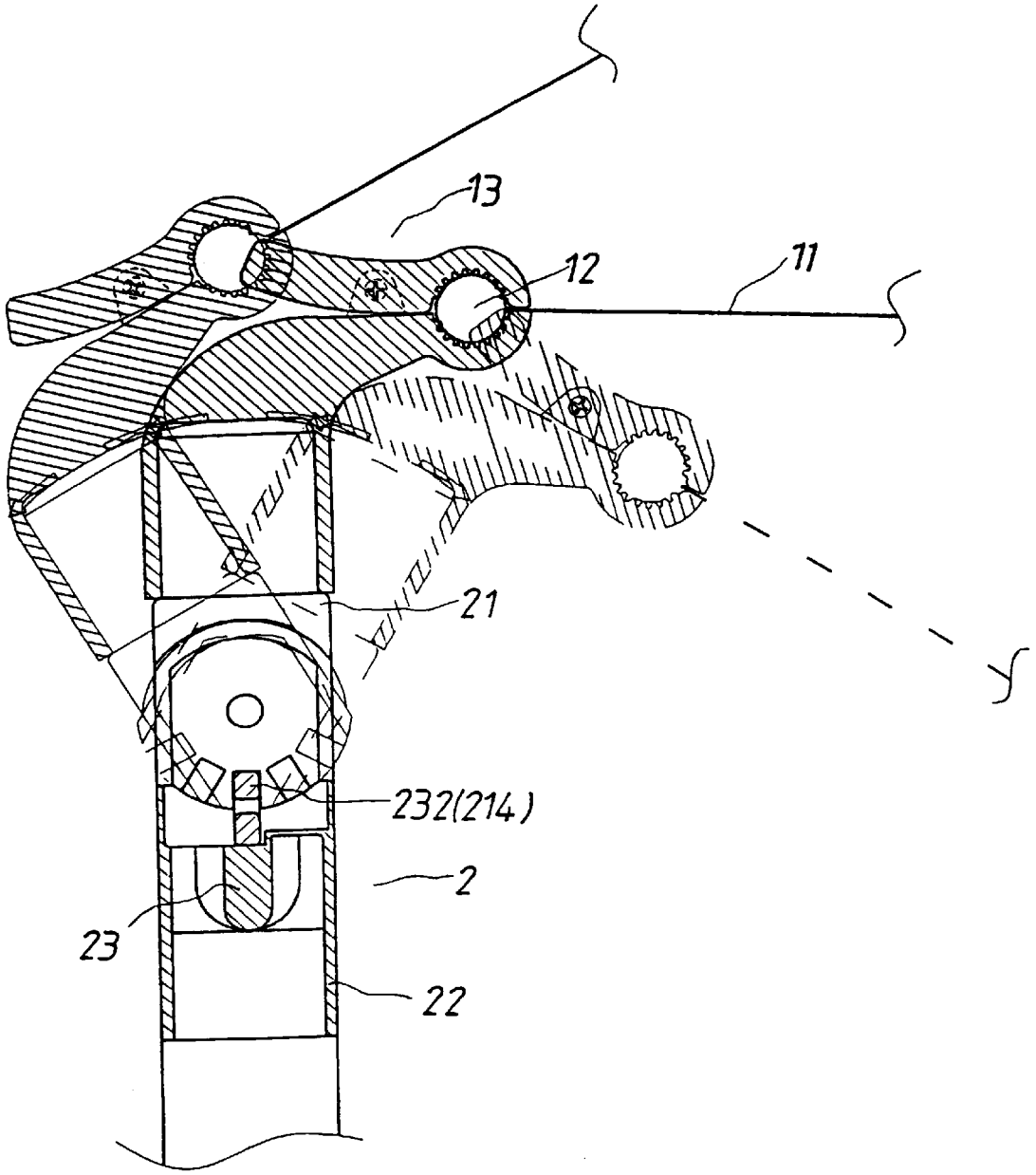
FIG. 7 is a schematic view illustrating an operation of an angle adjusting device of a preferred embodiment in accordance with the present invention.

Referring to FIGS. 3, 6 and 7, the push block 23 is pushed inward. The confining protrusion 232 of the push block 23 is disengaged from one of the recesses 214 of the click flange 213. The angle of the upper sleeve 21 will be adjusted.

Then the push block 23 is released, the confining protrusion 232 of the push block 23 will be inserted in one of the recesses 214 of the click flange 213.

Figure 4:
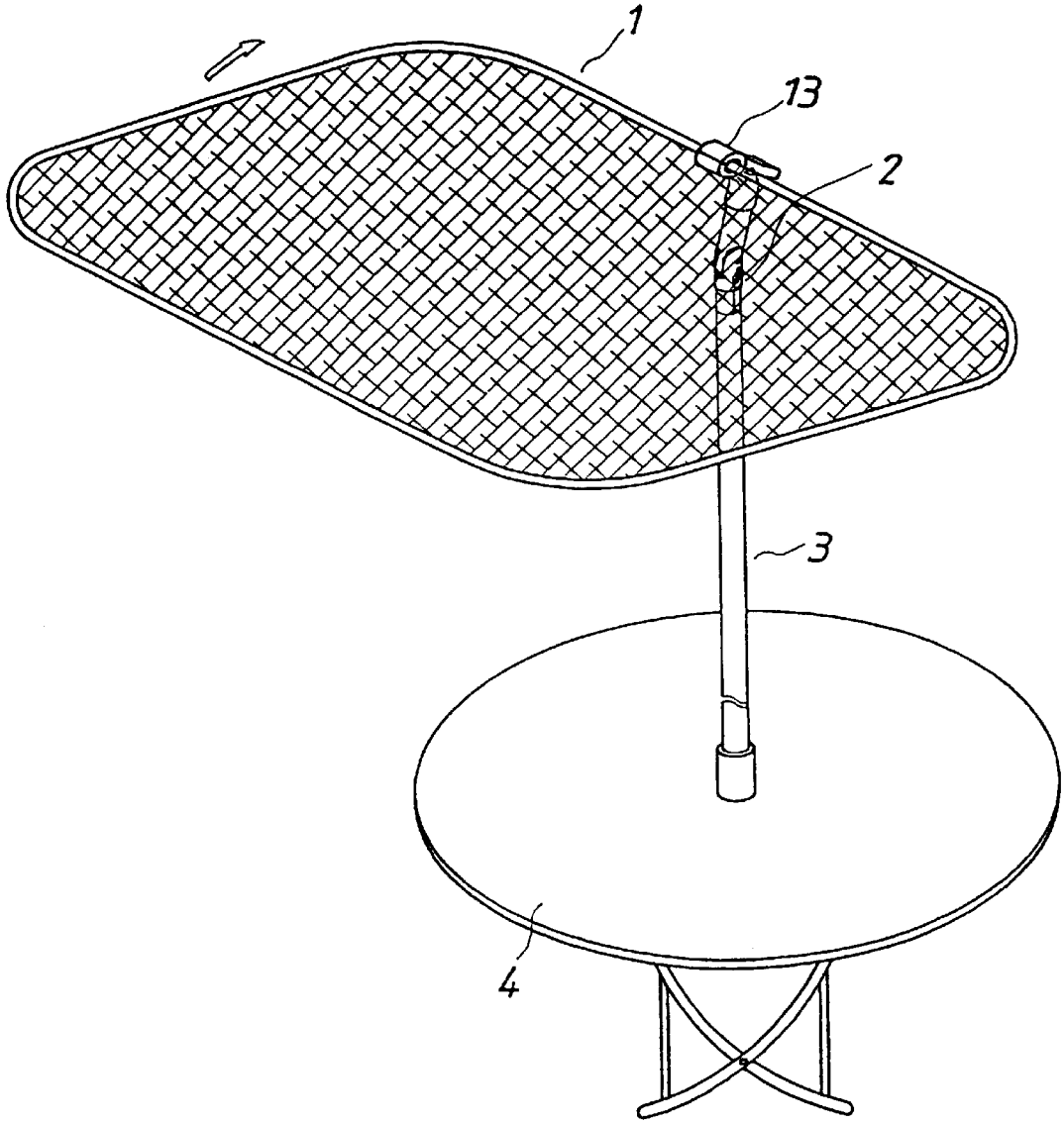
FIG. 4 is a schematic view illustrating a first application of a sunshade device of a preferred embodiment in accordance with the present invention.

Referring to FIG. 4, the extensible support 3 of the sunshade device is disposed on a table 4.

Figure 5:
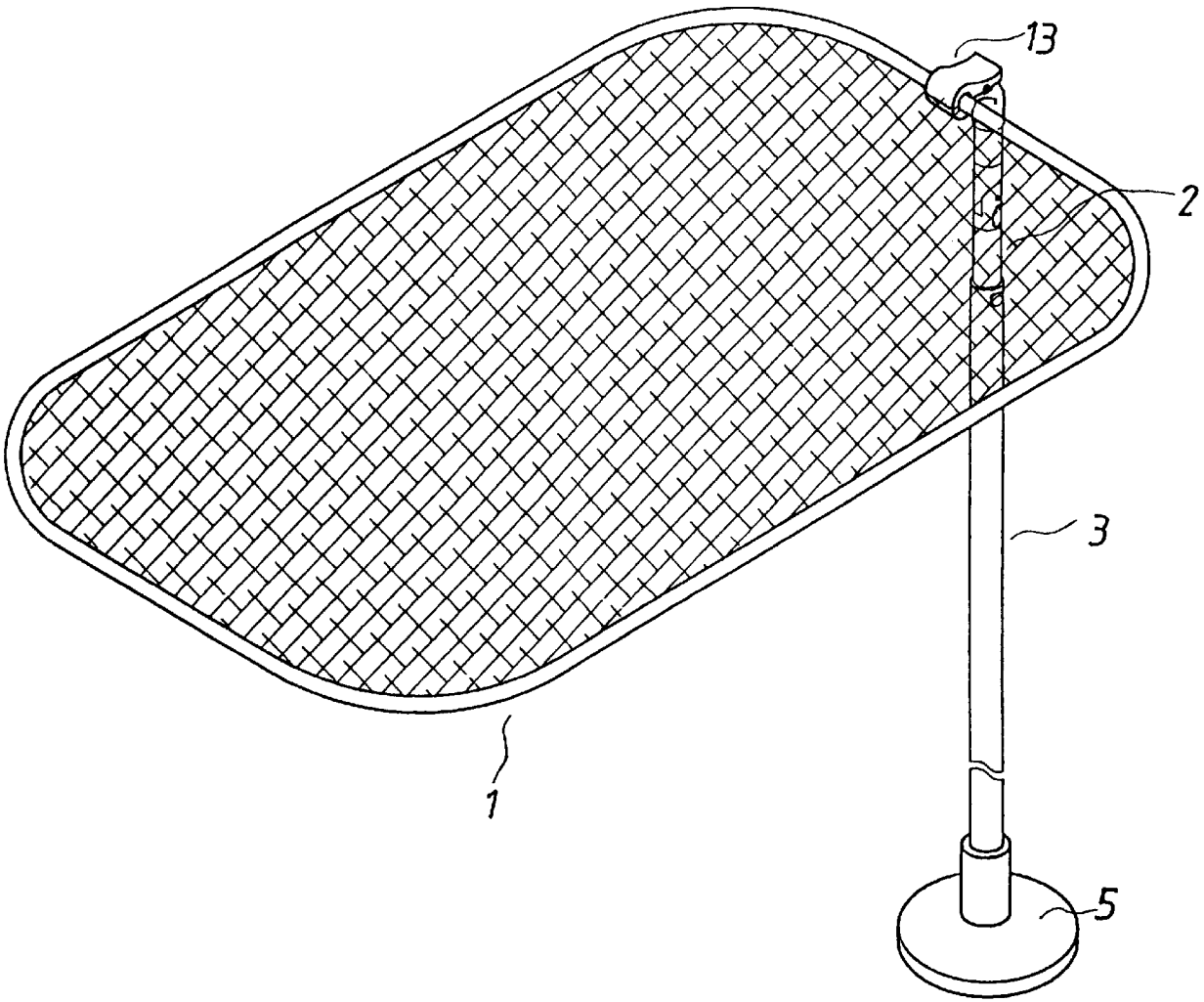
FIG. 5 is a schematic view illustrating a second application of a sunshade device of a preferred embodiment in accordance with the present invention.

Referring to FIG. 5, a lower end of the extensible support 3 of the sunshade device is inserted in a base seat 5.

Figure 8:
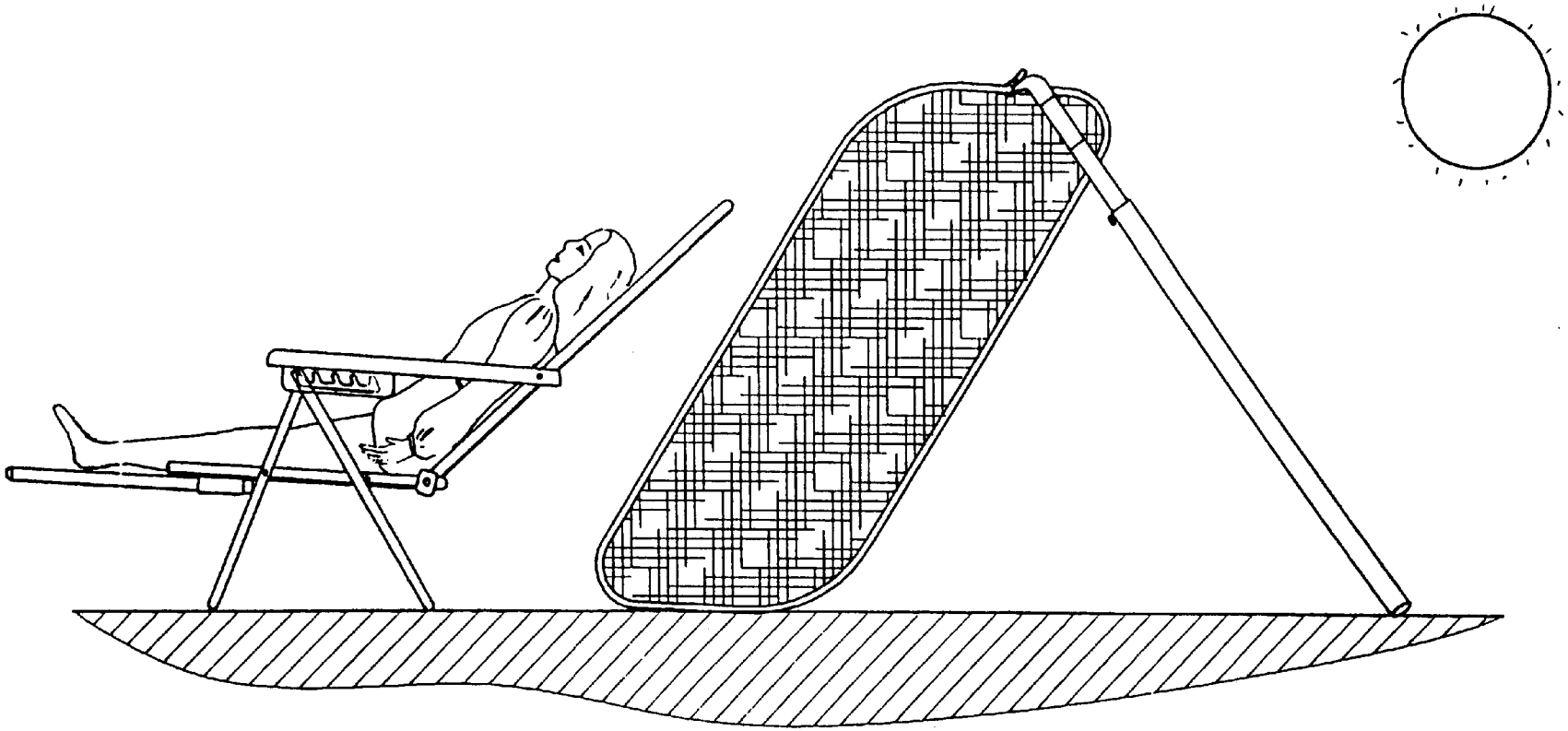
FIG. 8 is a schematic view illustrating a third application of a sunshade device of a preferred embodiment in accordance with the present invention.

Referring to FIG. 8, the flexible steel ring 12 of the sunshade awning 1 is inclined and placed on a ground.

Figure 10:
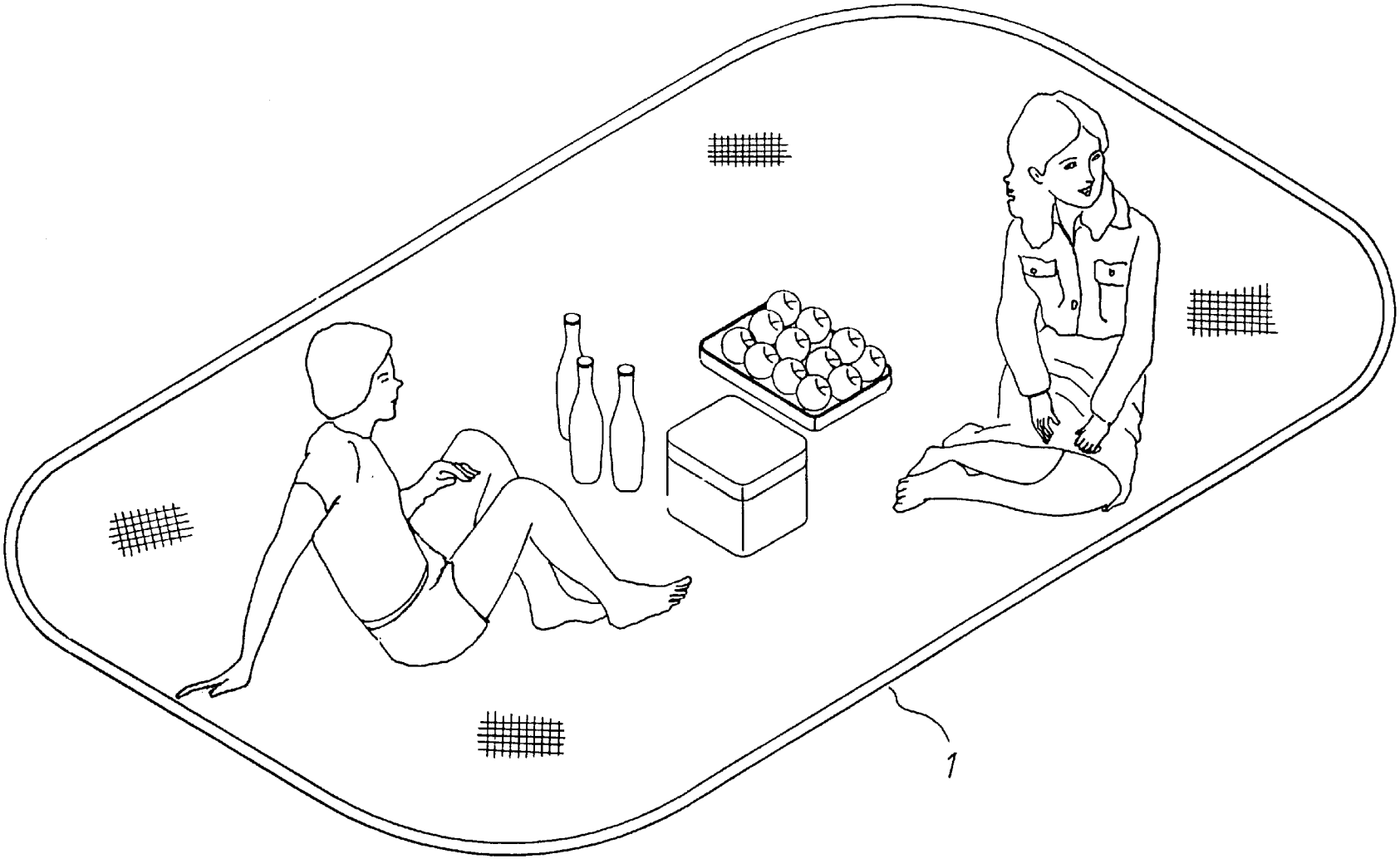
FIG. 10 is a schematic view illustrating a fourth application of a sunshade device of a preferred embodiment in accordance with the present invention.
Figure 11:
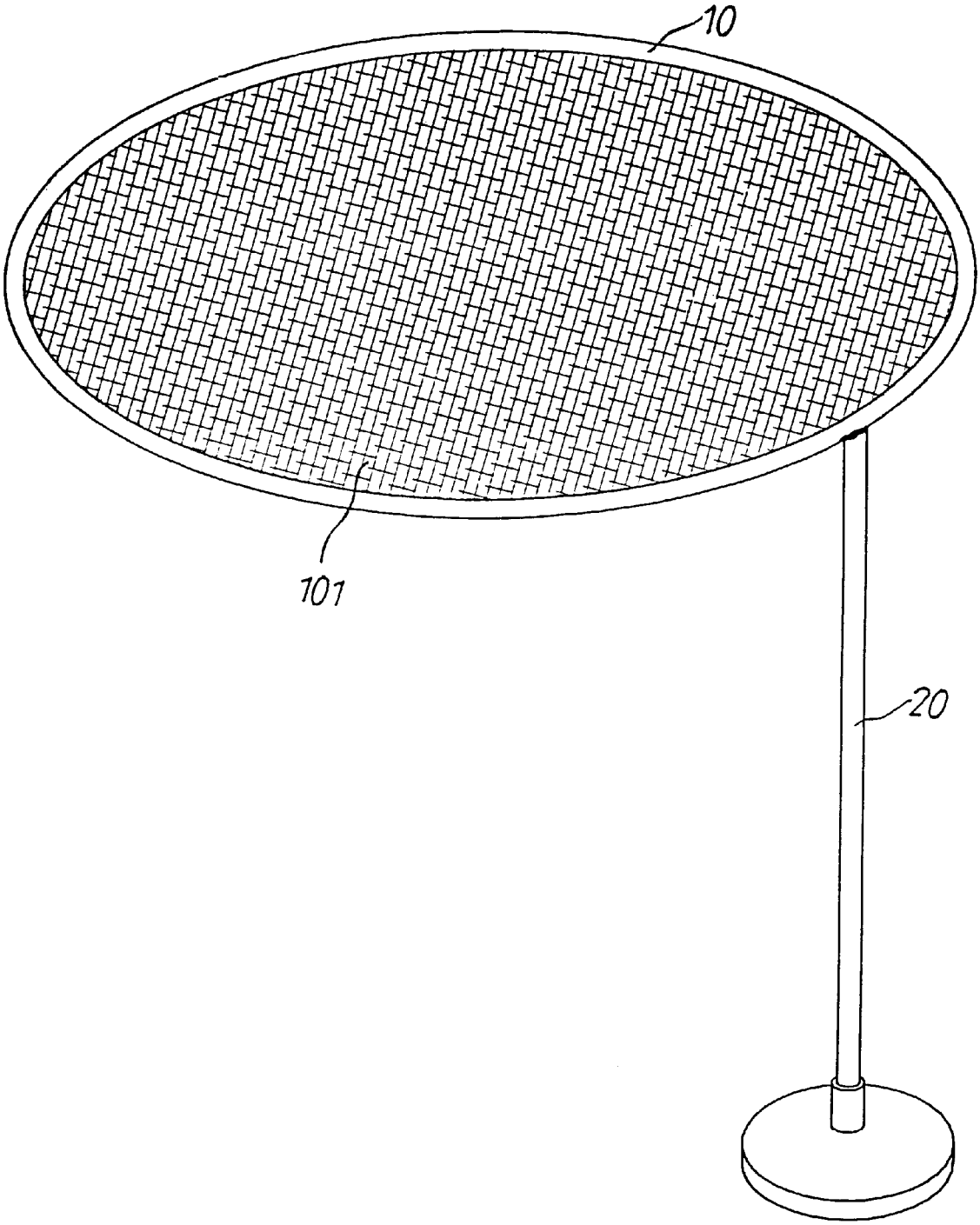
PRIOR ART FIG.11
FIG. 11 is a perspective assembly view of a conventional sunshade device of the prior art.

Referring to FIG. 10, the sunshade awning 1 is placed on a ground so that people can sit on the sunshade awning 1.

Figure 9:
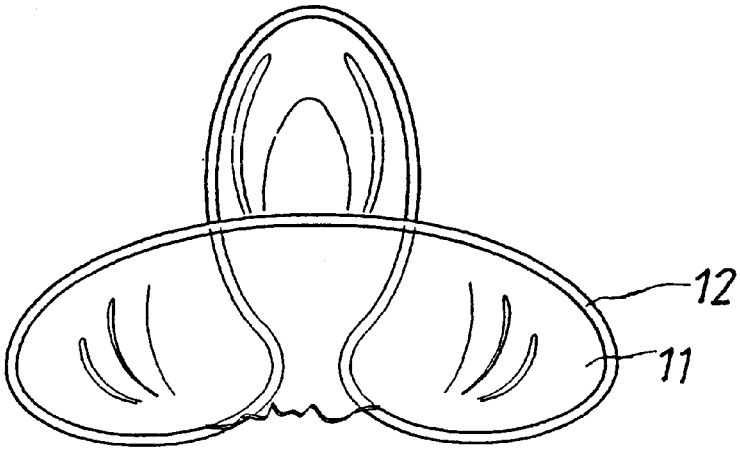
FIG. 9 is a schematic view illustrating a first step to fold a sunshade awning of a preferred embodiment in accordance with the present invention.
Figure 9A:
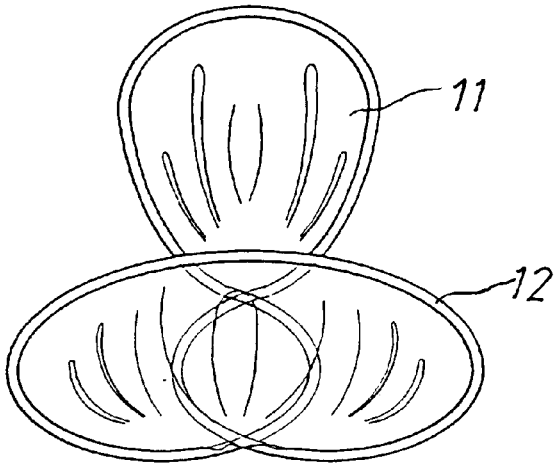
FIG. 9A is a schematic view illustrating a second step to fold a sunshade awning of a preferred embodiment in accordance with the present invention.
Figure 9B:
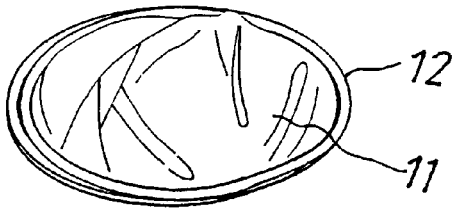
FIG. 9B is a schematic view illustrating a third step to fold a sunshade awning of a preferred embodiment in accordance with the present invention.

Referring to FIGS. 9, 9A, and 9B, the sunshade awning 1 is folded into a compact configuration.

The present invention has the following advantages.

The flexible steel ring 12 can be folded into a compact configuration.

The angle of the sunshade awning 1 can be adjusted according to the direction of the sunlight.

The clamp device 13, the angle adjusting device 2, and the extensible support 3 can be detached easily.

The present invention is not limited to the above embodiments but various modification thereof may be made. Furthermore, various changes in form and detail may be made without departing from the scope of the present invention.

I claim:

1. A sunshade device comprises:

a sunshade awning, a clamp device, an angle adjusting device, and an extensible support, the sunshade awning having a flexible steel ring and a fabric enclosed by the flexible steel ring, the extensible support having an outer pipe and an inner pipe inserted in the outer pipe, the clamp device having a lower tube, a first clamping plate, a second clamping plate disposed on the lower tube, and the second clamping plate engaging with the first clamping plate, a first groove of the first clamping plate and a second groove of the second clamping plate receiving the flexible steel ring, the angle adjusting device having an upper sleeve inserted in the lower tube and a lower sleeve engaging with the upper sleeve, the upper sleeve having an insertion journal, a pivot hole formed in the insertion journal, a click flange disposed on a bottom of the insertion journal, and a plurality of recesses formed on the click flange, the lower sleeve having a lower pipe inserted in the inner pipe, an upper notch receiving the insertion journal, a chamber formed beneath the upper notch, a generally oblong hole communicating with the chamber, and a through hole matching the pivot hole of the insertion journal, the chamber receiving a push block, the push block having a positioning post and a confining protrusion, the confining protrusion of the push block inserted in one of the recesses of the click flange, the generally oblong hole of the lower sleeve receiving a coiled spring, the positioning post of the push block inserted in an end of the coiled spring, and a pivot pin fastening the lower sleeve and the upper sleeve pivotally via the through hole of the lower sleeve and the pivot hole of the upper sleeve, when the push block is pushed inward, the confining protrusion of the push block is disengaged from one of the recesses of the click flange and the angle of the upper sleeve will be adjusted, when the push block is released, the confining protrusion of the push block will be inserted in one of the recesses of the click flange.

2. The sunshade device as claimed in claim 1, wherein the first groove of the first clamping plate has a plurality of first corrugated ribs.

3. The sunshade device as claimed in claim 1, wherein the second groove of the second clamping plate has a plurality of second corrugated ribs.

4. The sunshade device as claimed in claim 1, wherein an adjustment bolt fastens the outer pipe and the inner pipe together.

* * * * *